US010307916B2

(12) United States Patent
Hinderer

(10) Patent No.: US 10,307,916 B2
(45) Date of Patent: Jun. 4, 2019

(54) INTERCHANGEABLE BACKSPACER ASSEMBLY FOR A KNIFE

(71) Applicant: Richard D. Hinderer, Shreve, OH (US)

(72) Inventor: Richard D. Hinderer, Shreve, OH (US)

( * ) Notice: Subject to any disclaimer, the term of this patent is extended or adjusted under 35 U.S.C. 154(b) by 0 days.

(21) Appl. No.: 15/406,169

(22) Filed: Jan. 13, 2017

(65) Prior Publication Data

US 2017/0203447 A1 Jul. 20, 2017

Related U.S. Application Data

(60) Provisional application No. 62/279,875, filed on Jan. 18, 2016.

(51) Int. Cl.
*B26B 1/04* (2006.01)

(52) U.S. Cl.
CPC ..... *B26B 1/04* (2013.01)

(58) Field of Classification Search
CPC .. B26B 1/00; B26B 1/04; B26B 1/042; B26B 1/044; B26B 1/046; B26B 1/048; B26B 1/06; B26B 1/08; B26B 1/10
USPC ..... 30/158–160
See application file for complete search history.

(56) References Cited

U.S. PATENT DOCUMENTS 4,442,559 A * 4/1984 Collins ..... B26B 3/06 30/153
5,450,670 A * 9/1995 Sakai ..... B26B 11/00 224/232
5,495,673 A * 3/1996 Gardiner ..... B26B 11/00 30/155
5,528,831 A * 6/1996 Fortenberry ..... B25F 1/04 30/160
5,546,662 A * 8/1996 Seber ..... B26B 1/044 30/160
5,769,094 A * 6/1998 Jenkins, Jr. ..... B26B 1/048 30/160
5,966,816 A * 10/1999 Roberson ..... B26B 1/046 30/156
6,352,010 B1 * 3/2002 Giarritta ..... B26B 1/04 7/168
6,427,335 B1 * 8/2002 Ralph ..... B26B 1/048 30/160
6,675,485 B1 * 1/2004 Shih ..... B26B 1/10 30/321
6,701,626 B2 * 3/2004 Knoop ..... B23D 51/01 30/331
7,062,857 B1 * 6/2006 Nenadic ..... B26B 1/042 30/161
7,134,207 B2 * 11/2006 Ping ..... B26B 1/042 30/125

(Continued)

*Primary Examiner* — Jason Daniel Prone
*Assistant Examiner* — Richard D Crosby, Jr.

(57) ABSTRACT

An interchangeable backspacer assembly for knives that allows different back spacers to be readily interchanged to selectively incorporate additional functionality, such as lanyard loops, glass breakers, and pry tools, into the knives. The interchangeable backspacer assembly includes a pair of standoffs, a backspacer and a locking set screw. The standoffs are connected between the side members of the knife handle to form an opening for receiving the backspacers at the distal end of the handle. The backspacers are held in place by a locking set screw turned into a threaded bore in the backspacer.

13 Claims, 8 Drawing Sheets

(56) References Cited

U.S. PATENT DOCUMENTS 7,146,667 B2 * 12/2006 Elsener ..... B25F 1/04 7/118
7,578,064 B2 * 8/2009 Busse ..... B26B 1/048 30/153
7,797,838 B2 * 9/2010 Chu ..... B26B 1/08 30/151
8,464,382 B2 * 6/2013 Chu ..... B26B 11/006 7/118
8,939,054 B2 * 1/2015 Hawk ..... B26B 1/04 30/151
9,505,141 B2 * 11/2016 Duey ..... B26B 1/046
9,630,328 B2 * 4/2017 Koenig ..... B26B 1/02
9,737,997 B1 * 8/2017 Marfione ..... B26B 1/04
2007/0068000 A1 * 3/2007 Onion ..... B26B 1/02 30/160
2007/0068002 A1 * 3/2007 Onion ..... B26B 1/044 30/161
2009/0255127 A1 * 10/2009 Seymour ..... B26B 1/02 30/161
2010/0299935 A1 * 12/2010 Ping ..... B26B 1/042 30/161
2011/0265332 A1 * 11/2011 Cornell ..... B26B 1/04 30/123
2014/0198485 A1 * 7/2014 Karchon ..... B26B 11/008 362/119
2015/0217461 A1 * 8/2015 Langenwalter ..... B26B 11/00 7/118
2016/0121493 A1 * 5/2016 Ikoma ..... B26B 1/048 30/161
2016/0221174 A1 * 8/2016 Raymond ..... B25F 1/04
2016/0256994 A1 * 9/2016 Kerulis ..... B26B 3/02
2016/0279810 A1 * 9/2016 Demko ..... B26B 1/042
2017/0203447 A1 * 7/2017 Hinderer ..... B26B 1/04

* cited by examiner 220
230

320
330

420
430

520
524
531
530

620
630

INTERCHANGEABLE BACKSPACER ASSEMBLY FOR A KNIFE

This application claims the benefit of U.S. Provisional Application No. 62/279,875 filed Jan. 18, 2016, the disclosure of which is hereby incorporated by reference.

This invention relates to knives and in particular a knife having an interchangeable back spacer assembly.

BACKGROUND AND SUMMARY OF THE INVENTION

Knife handles often use "standoffs" and "backspacers" interposed between two side members of the handle. In folding knives, standoffs and back spacers are simply used to provide the open space between the handle sides for receiving a folding blade when closed. In fixed blade knifes, standoffs and backspacers provide weight or structural integrity to the handles of fixed blade knives.

The interchangeable backspacer assembly of this invention allows different backspacers to be readily interchanged to selectively incorporate additional functionality into the handle of a knife. The interchangeable backspacer assembly includes a pair of standoffs and interchangeable backspacers. Different backspacers may be configured to incorporate different features and functionality, such as lanyard loops, screwdriver heads, glass breakers, pry tools, and the like. The standoffs are incorporated into the knife handle between the side members of the knife handle to form an open interior for receiving the back spacers at the distal end of the handle. Each backspacer has a pair of slots spaced and dimensioned to receive one of the standoffs. When the backspacer is inserted into the handle opening, both standoffs are seated within the slots formed in the backspacers. The backspacers are secured between the standoffs and locked in place by a single locking set screw, which abuts one of the standoffs. The standoffs provide the space for receiving the interchangeable backspacers, while maintaining the structural integrity of the knife handle when the spacer is removed.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
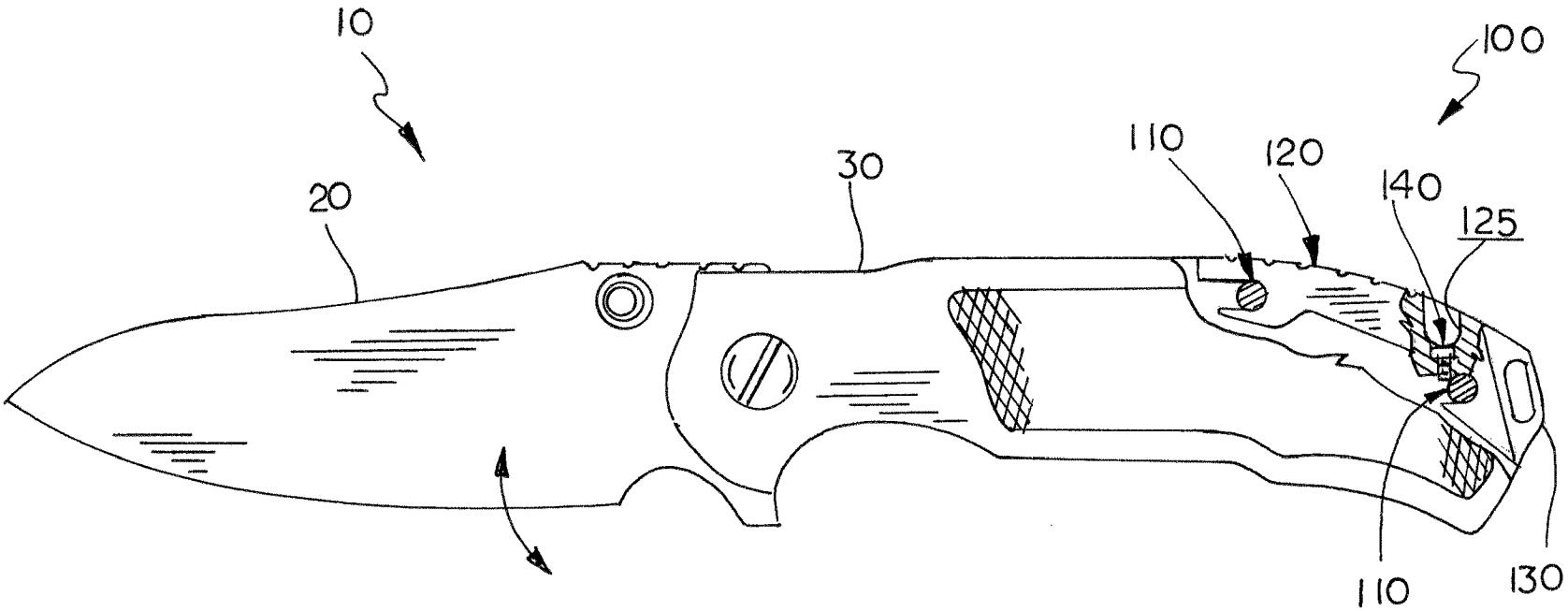
FIG. 1 is a left side view of a conventional folding knife incorporating an exemplary embodiment of the interchangeable backspacer assembly of this invention.
Figure 2:
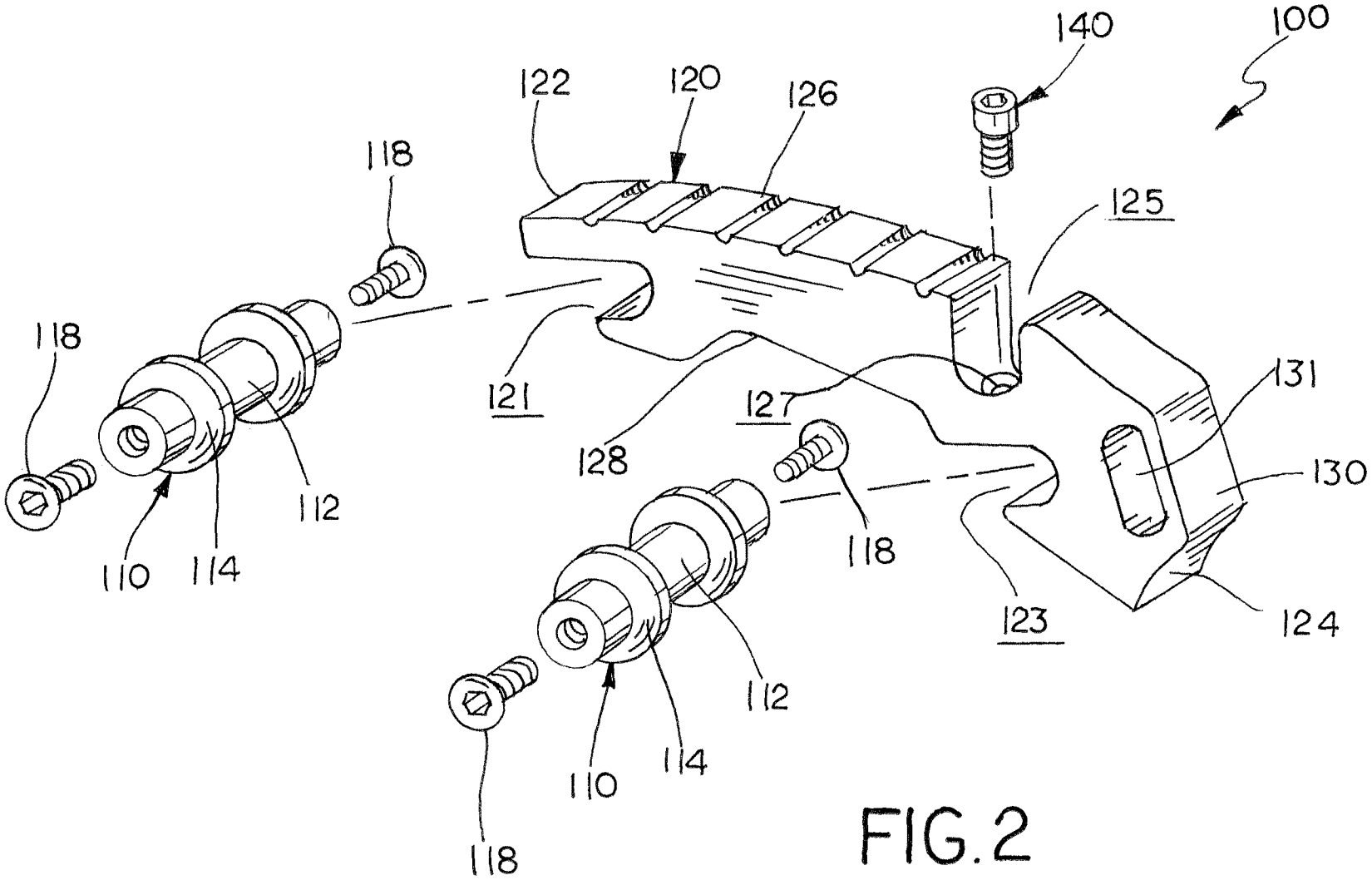
FIG. 2 is an exploded perspective view of the interchangeable backspacer assembly of FIG. 1.
Figure 4:
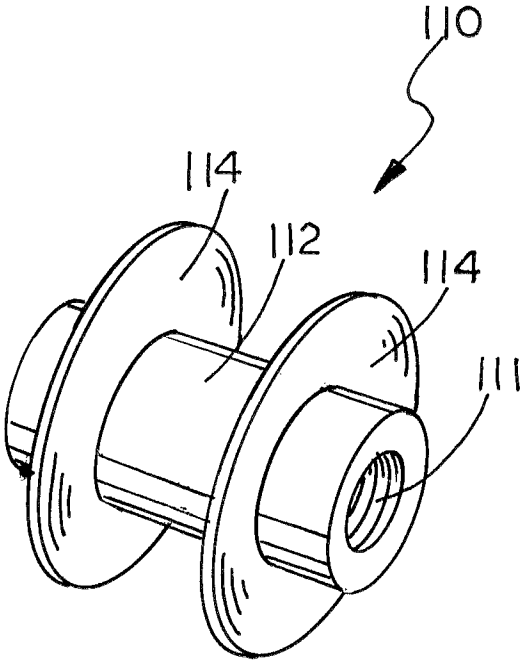
FIG. 4 is a perspective view of the standoffs used in the interchangeable backspacer assembly of FIG. 1.
Figure 3:
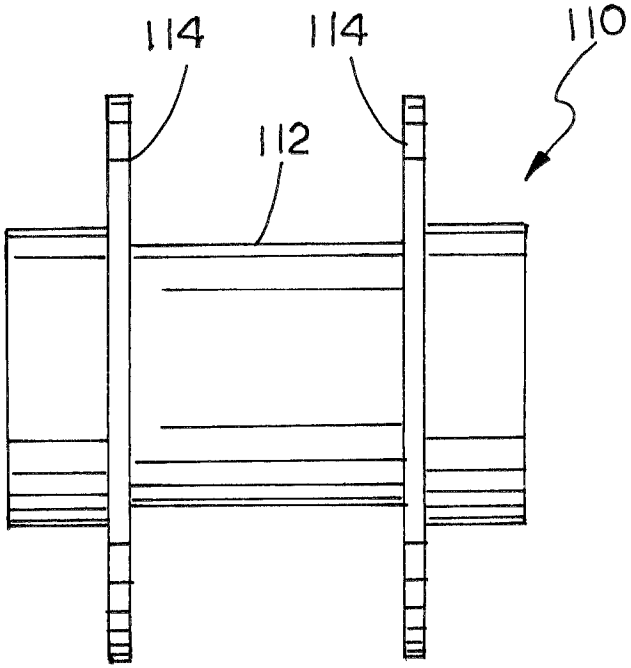
FIG. 3 is a side view of the standoffs used in the interchangeable backspacer assembly of FIG. 1.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Referring now to the drawings, FIGS. 1-8 illustrate an exemplary embodiment of the interchangeable backspacer assembly 100, which is incorporated into a conventional folding knife 10. As shown, knife 10 includes a blade 20 pivotally coupled to a handle 30 for rotation between an open position and a closed position. Handle 30 consists of a pair of side members 32 (left and right sides) that are spaced apart to form an area 31 for receiving blade 20 therein in the closed position. Knife 10 is illustrated as a "frame-lock" style folding knife, although, other styles of folding knives, including but not limited to "lock-back" and "liner-lock" style knives may be modified within the teachings of the present invention. In addition, the teachings of this invention may be readily applied to fixed blade knives, as well. For ease of explanation, many commonly known features of folding knives are omitted in the figures and description of embodiments of the invention. For example, fasteners, such as machine screws, bolts, rivets, pins, washers, etc. are well known in the art and need not be discussed in detail. Other features are described to provide context for the embodiment described, but are not essential to the invention or particular embodiment described and are not to be construed as being essential to the claimed embodiment unless so indicated.

Interchangeable backspacer assembly 100 includes a pair of standoffs 110, a removable backspacer 120 and a locking screw 140. Standoffs 110 are integrated in the knife handle 30 between side members 32. Backspacer 120 connects to standoffs 110 and is held within handle 30 by locking screw 140.

Standoffs 110 are cast, machined or otherwise formed from a suitable metal, such as steel, brass, copper, aluminum or titanium, but may be formed from a suitable composite ceramic or polymer material. Each standoff 110 includes a cylindrical central barrel 112 and a pair of spaced annular flanges 114. Standoffs 110 are affixed to handle 30 by a pair of screws 118, which extend through holes in the handle side members 32 and turn into thread axial bores in the standoffs. As shown in FIGS. 1 and 5-8, standoffs 110 are positioned near the distal end of handle 30 and spaced apart from each other along the back edge of handle 30. Standoffs 110 are connected between handle side members 32 to provide an opening 33 for receiving backspacer 120 at the distal end of handle 30.

Backspacer 120 may be cast, cut, stamped, machined or otherwise formed from a suitable metal, but may be formed from a suitable composite ceramic or polymer material. Backspacer 120 is generally cut or stamped from a suitable sheet metal, such as steel, brass, copper, aluminum or titanium as a flat piece cut and shaped to seat between handle side members 32 and standoffs 110. Backspacer 120 is configured to restrictively seat within handle opening 33 and conform to the shape and contour of handle 30. Backspacer 120 has flat opposed sides and is configured to have proximal and distal ends 122 and 124, a back edge 126 and an inner edge 128. As shown, back edge 126 and distal end 124 of backspacer 120 are configured to correspond to and align with the contour of the top and end of handle 30 when backspacer 120 is fitted to the handle. Backspacer 120 has a pair of open-ended standoff slots 121 and 123 dimensioned to restrictively receive the central barrels 112 of standoffs 110. Slot 121 is formed near the proximal end of backspacer 120 and slot 123 is formed near the distal end of backspacer 120. As shown, the slots 121 and 123 are oriented to be longitudinally parallel to but spaced from each other with their open ends facing towards the proximal end of backspacer 120. Back spacer 120 also has a set screw slot 125 formed in back edge 126 and a threaded bore 127 that extends through the body backspacer 120 between screw slot 125 and standoff slot 123.

Figure 5:
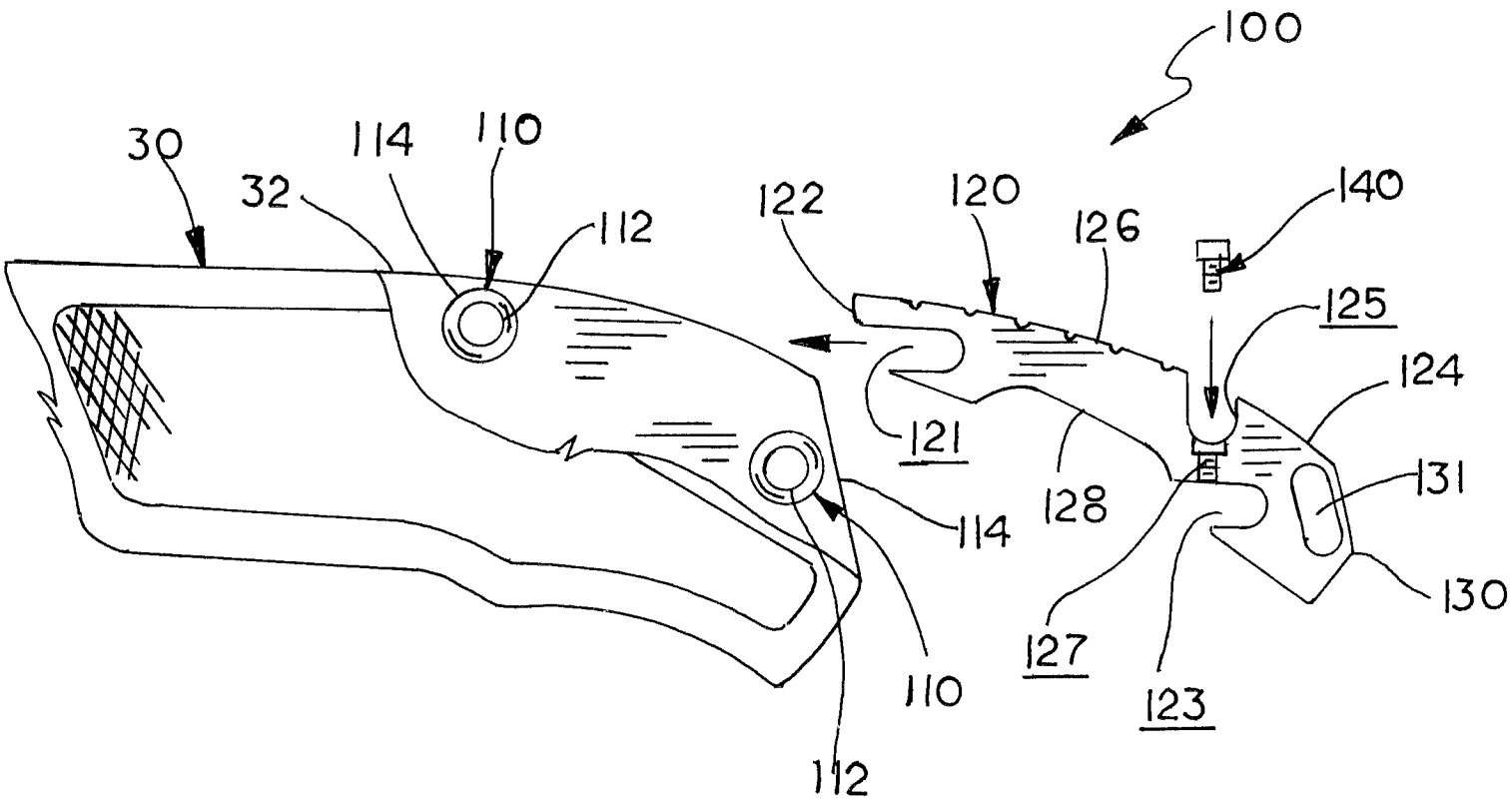
FIG. 5 is a partial side view of the knife of FIG. 1 with a portion cutaway showing the backspacer removed from the knife handle.
Figure 6:
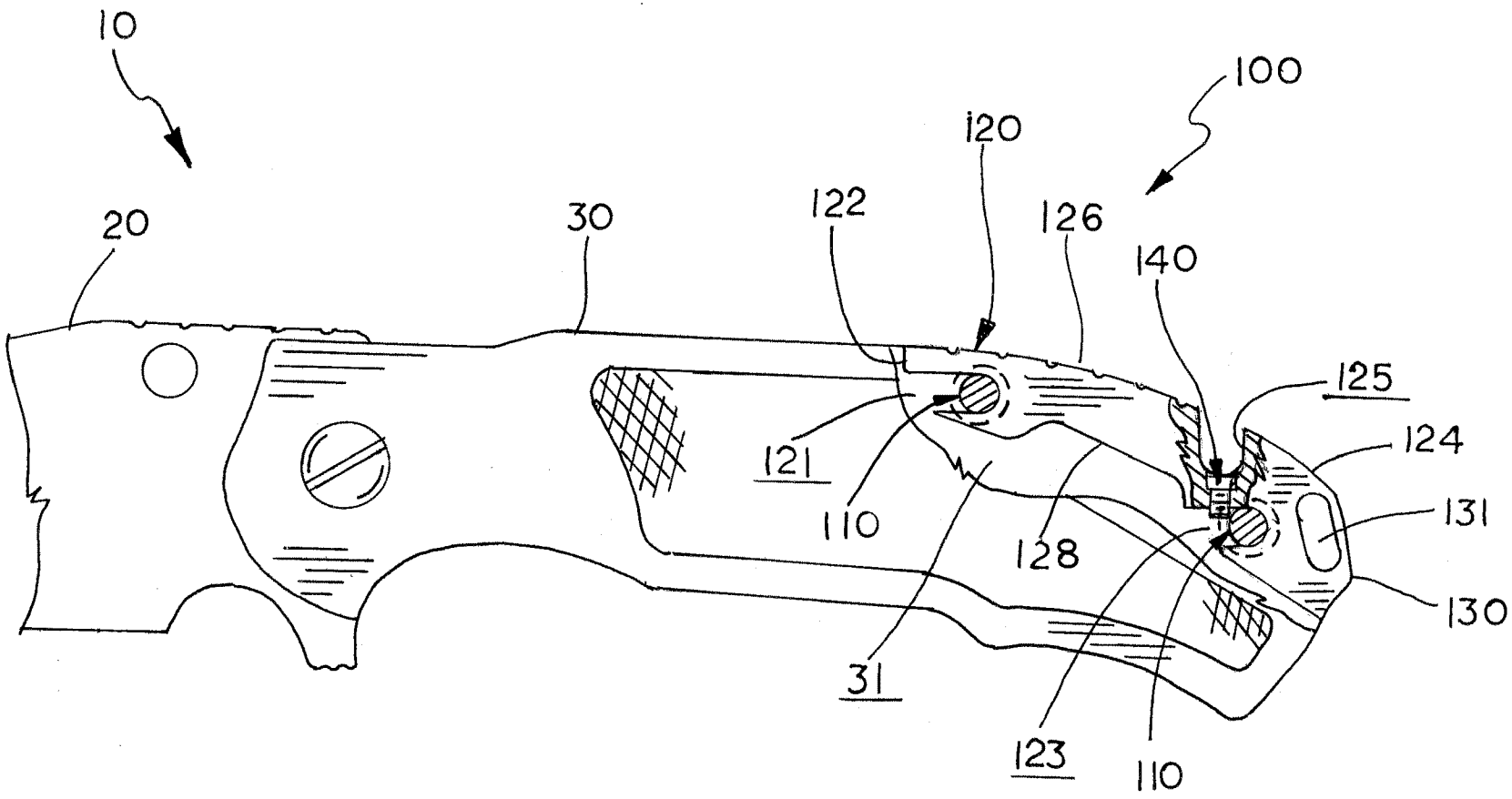
FIG. 6 is a partial side view of the knife of FIG. 1 with a portion cutaway showing the backspacer fitted to the knife handle.
Figure 7:
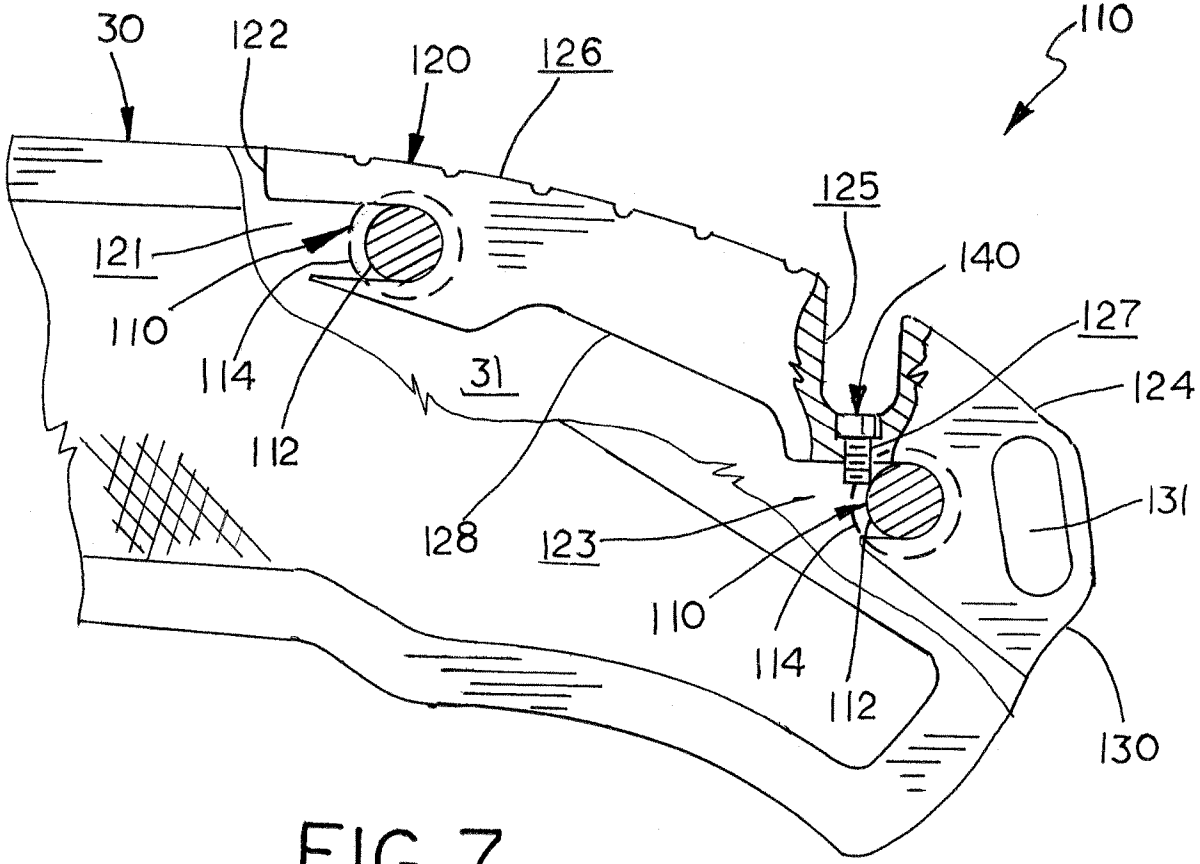
FIG. 7 is another partial side view of the knife of FIG. 1 with a portion cutaway showing the backspacer fitted to the knife handle.
Figure 8:
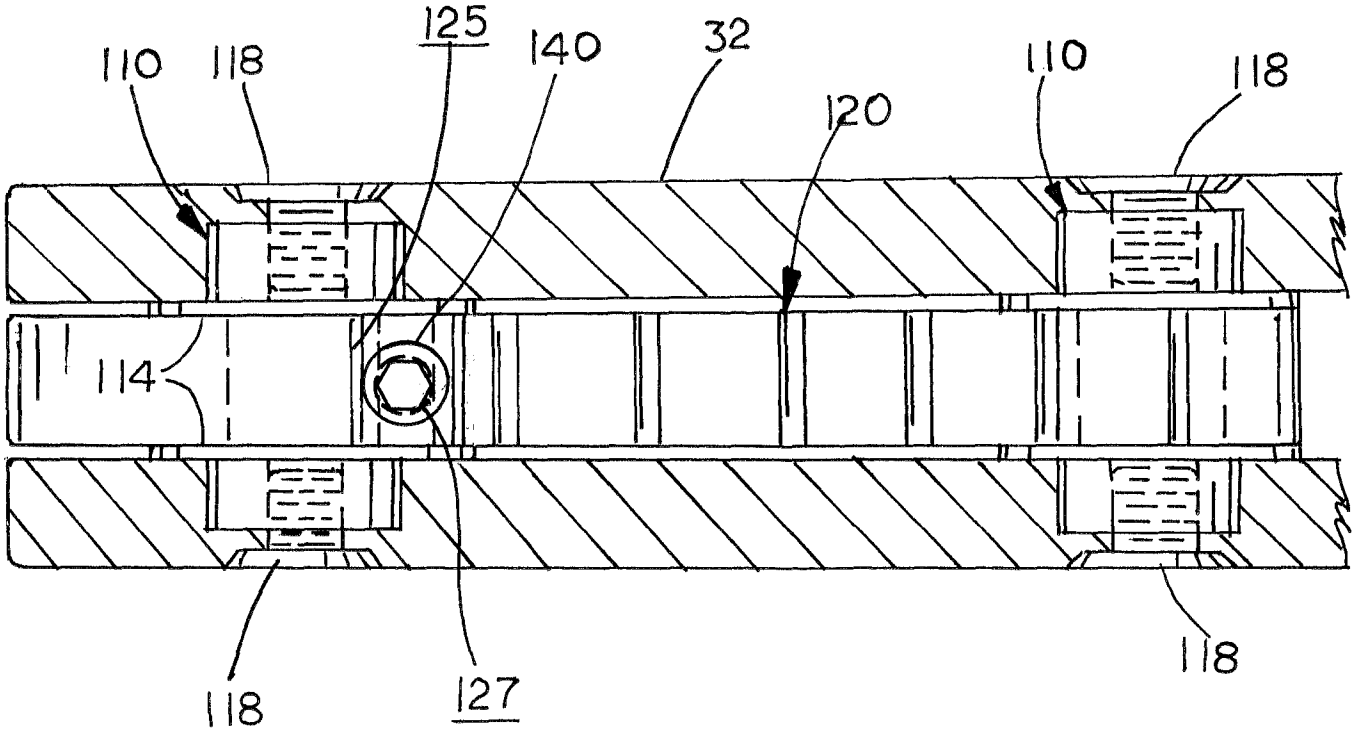
FIG. 8 is a partial top view of the knife of FIG. 1 with a portion cutaway showing the backspacer fitted to the knife handle.

As shown in FIGS. 1, 5-8, backspacer 120 is removably fitted to handle 30 within handle opening 33 and secured by locking set screw 140. Backspacer 120 slides into handle opening 33 from the rear of handle 30 (FIG. 5). When fully inserted into handle opening 33, Central barrels 112 are seated with standoff slots 121 and 123 (FIG. 6). Locking set screw 140 is turned into a threaded bore 127 to secure the backspacer within handle opening 33 (FIG. 7). Set screw 140 extends partially from the threaded bore 127 to abut central barrel 112 of the rearmost standoff 110, which holds and locks backspacer 120 within handle opening 33. Backspacer 120 is removed by simply turning locking screw 140 to retract the screw end out of engagement with the rearmost standoff 110 and manually sliding the backspacer rearward from handle 30.

Figures 9, 10, 11, 12, 13:
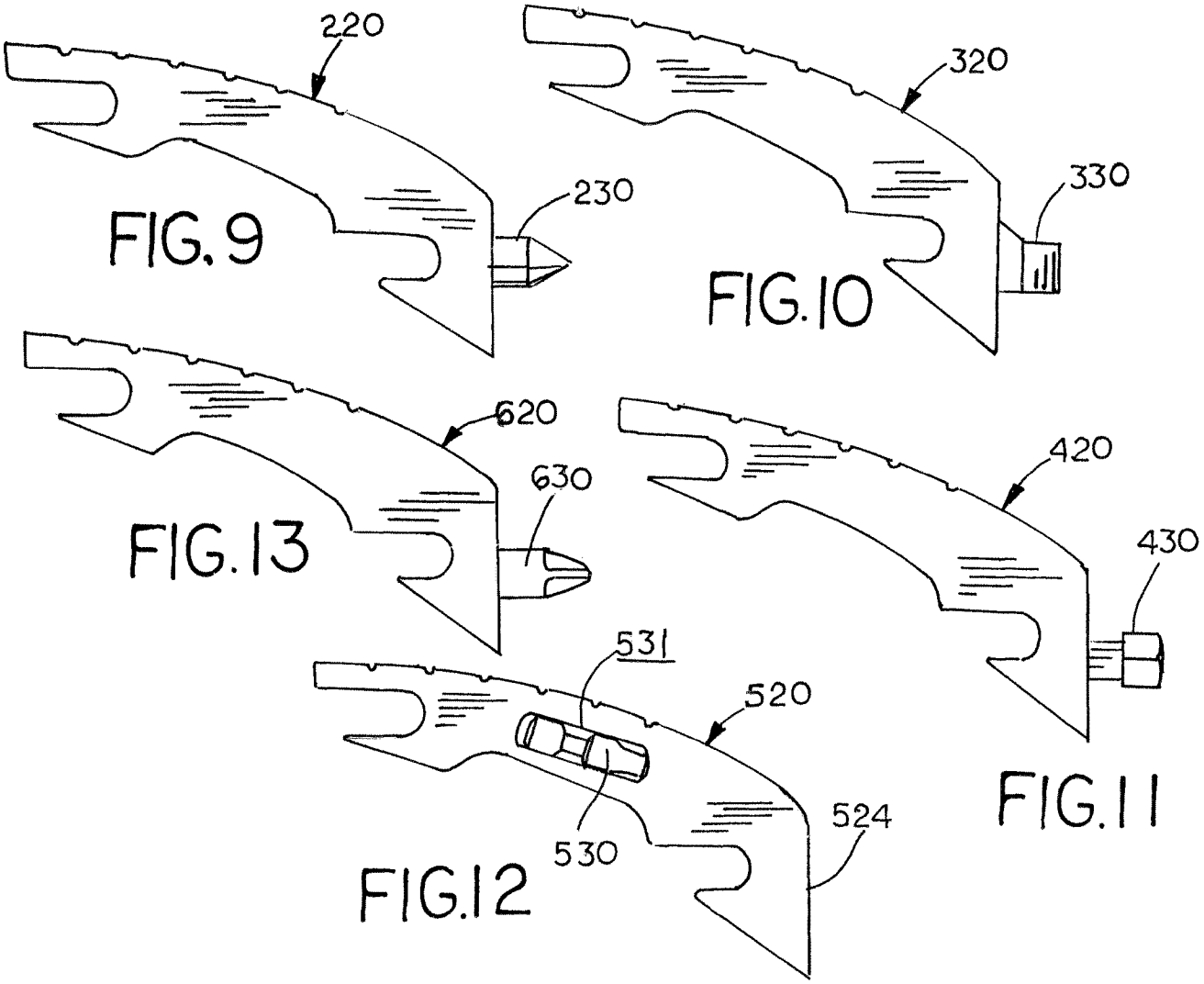
FIG. 9 is a side view of a second embodiment of the backspacer.
FIG. 10 is a side view of a third embodiment of the backspacer.
FIG. 11 is a side view of a fourth embodiment of the backspacer.
FIG. 12 is a side view of a fifth embodiment of the backspacer.
FIG. 13 is a side view of a sixth embodiment of the backspacer.

The backspacer assembly of this invention allows backspacers to be readily interchanged to provide varying features and functionality to the knife handle. Different backspacers can be uniquely configured with different features or functions. As shown in FIGS. 1-8, backspacer 120 is configured to have an integral lanyard loop 130. Lanyard loop 130 has a slotted opening 131 for receiving a lanyard cord or other retaining device. FIG. 9 illustrates backspacer 220 having an integral glass punch 240 extending from its distal end. FIG. 10 illustrates backspacer 320 having an integral flat screwdriver or pry head 330 extending from the distal end. FIG. 11 illustrates backspacer 420 includes an integral hex head 430 for use with a drive sockets. FIG. 12 illustrates backspacer 520 having a straight distal end, which aligns flushly with the end of handle 30, but includes central cutout 531 that houses a bit tool 530 for storage within handle opening 33. FIG. 13 illustrates backspacer 620 having an integral phillips head screwdriver head 630.

One skilled in the art will note several advantages of the backspacer assembly of this invention. The assembly allows additional functionality to be added to the knife by interchanging backspacers. The backspacers can be configured to have different functionality, by integrating tools and features into the body and end of the backspacer. Embodiments of the back spacer may include lanyard loops, screwdriver heads, and pry tool heads. The backspacers are secured between the standoffs and locked in place by a single locking set screw. The standoffs provide the space for receiving the interchangeable backspacers in the knife handle while maintaining the structural integrity of the knife handle when the spacer is removed.

The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A knife handle comprising a pair of handle side members defining a distal end and a blade end, and an interchangeable backspacer assembly, the interchangeable backspacer assembly comprising;

a backspacer; a first standoff; a second standoff; and a locking member, the first standoff and the second standoff mounted to the knife handle between the pair of handle side members to space the pair of handle side members apart at the handle distal end and define an open handle interior between the pair of handle side members at the handle distal end for receiving the backspacer therein, the backspacer removably supported between the first standoff and the second standoff within the open handle interior independent of the pair of side members, the backspacer having an elongated first slot defined therein for restrictively receiving the first standoff when the backspacer is seated within the open handle interior and an elongated second slot defined therein for restrictively receiving the second standoff when the backspacer is seated within the open handle interior, the locking member operatively connected to the backspacer to engage one of the first standoff and second standoff when the backspacer is seated within the open handle interior to hold the backspacer within the open handle interior.

2. The knife handle of claim 1 wherein the first standoff is mounted to the knife handle between the distal end and blade end of the knife handle, the second standoff is mounted to the knife handle between the first standoff and the distal end of the knife handle.

3. The knife handle of claim 1 wherein the each of the first standoff and the second standoff includes a cylindrical central barrel and a pair of spaced annular standoff flanges, the central barrels of each of the first standoff and the second standoff are configured to be shiftably received within one of the first slot and the second slot, the standoff flanges of each of the first standoff and the second standoff are spaced apart to receive the backspacer therebetween.

4. The knife handle of claim 1 wherein the first slot having an open slot end through which the first standoff is received, the second slot having an open slot end through which the second standoff is received.

5. The knife handle of claim 4 wherein the first slot and the second slot are defined in the backspacer so that the longitudinal axis of the first slot and the second slot are spaced parallel to and apart from each other.

6. The knife handle of claim 1 wherein the backspacer has a flat body and a threaded bore extending through the body to emerge into one of the first slot and the second slot.

7. The knife handle of claim 6 wherein the locking member is a set screw turned into the threaded bore of the backspacer body.

8. The knife handle of claim 1 wherein the backspacer has a first backspacer end and a second backspacer end.

9. The knife handle of claim 8 wherein the backspacer has a tool part extending from the second backspacer end.

10. The knife handle of claim 9 wherein the tool part is a glass breaker.

11. The knife handle of claim 9 wherein the tool part is a pry bar.

12. The knife handle of claim 9 wherein the tool part is a screw driver.

13. The knife handle of claim 9 wherein the tool part is a lanyard loop.

* * * * *